US006379170B1

(12) United States Patent
Czeschka et al.

(10) Patent No.: US 6,379,170 B1
(45) Date of Patent: Apr. 30, 2002

(54) METHOD OF MOUNTING ELECTRICAL PLUG-IN CONNECTIONS AND AUXILIARY MOUNTING MEANS FOR CARRYING OUT THE METHOD

(75) Inventors: Franz Czeschka, Rechberghausen; Jürgen Lappöhn, Gammelshausen, both of (DE)

(73) Assignee: ERNI Elektroapparate GmbH, Adelberg (DE)

( * ) Notice: Subject to any disclaimer, the term of this patent is extended or adjusted under 35 U.S.C. 154(b) by 0 days.

(21) Appl. No.: 09/483,864

(22) Filed: Jan. 18, 2000

(30) Foreign Application Priority Data

Jan. 19, 1999 (DE) ..... 199 01 962

(51) Int. Cl.[7] ..... H01R 13/28

(52) U.S. Cl. ..... 439/291; 439/940; 174/53; 174/59

(58) Field of Search ..... 174/53, 59; 439/291, 439/940

(56) References Cited

U.S. PATENT DOCUMENTS 3,732,525 A * 5/1973 Henschen et al. ..... 439/291
4,221,446 A * 9/1980 Niles et al. ..... 439/291
5,535,513 A 7/1996 Frantz
6,191,361 B1 * 2/2001 Matty ..... 174/53
6,193,561 B1 * 2/2001 Harting et al. ..... 439/682

FOREIGN PATENT DOCUMENTS

| | | |
|---|---|---|
| DE | 4128329 | 3/1993 |
| DE | 9420283 | 5/1995 |
| DE | 296 17 668 U1 | 1/1997 |
| DE | 195 36 005 A1 | 4/1997 |
| EP | 0633634 | 1/1995 |
| EP | 0708586 | 4/1996 |

* cited by examiner

*Primary Examiner*—Dean A. Reichard
*Assistant Examiner*—Dhiru R Patel
(74) *Attorney, Agent, or Firm*—Friedrich Kueffner

(57) ABSTRACT

The invention relates to auxiliary mounting means for electrical plug-in connections for placing plug-in strips on a mounting surface, preferably by means of a manipulator, wherein during mounting of a further component via the mounting movement of this further component at least partial areas of the auxiliary mounting means are bent or buckled so that the further component can be placed with minimal spacing to the other component, wherein at the same time the mounting time is lowered.

5 Claims, 3 Drawing Sheets

METHOD OF MOUNTING ELECTRICAL PLUG-IN CONNECTIONS AND AUXILIARY MOUNTING MEANS FOR CARRYING OUT THE METHOD

BACKGROUND OF THE INVENTION

1. Field of the Invention

The invention relates to a method of mounting auxiliary mounting means for electrical plug-in connections.

2. Description of the Related Art

Many electrical plug-in connections are known in practice. A special field are the electrical plug-in connections which are of a multi-contact configuration. Such multi-contact plug-in connections comprise plugs and sockets or strips in standard or special configurations which inter alia are also placed onto mounting surfaces and subsequently or simultaneously secured thereat, for example, by soldering, adhesives, snap connections etc. The mounting surfaces in this context may be base plates for very complex electrotechnical installations, but, for example, can also be printed circuit boards for computers, on which the plugs, sockets or strips of the plug-in connections are arranged.

These mounting surfaces have a common problem in that the arrangement of components is very tight. The situation is especially problematic when the placement of components on such a printed circuit board is carried out by a manipulator (for example, a robot).

The multi-contact plugs and sockets have a common feature:

In most plug contact components there is hardly any material surrounding the plug contacts in the partial area of the housing surface penetrated by the plug contact openings. When it is now desired to mount such a multi-contact plug-in connection by means of a manipulator on a mounting surface and when only the aforementioned partial area with the plug-contact openings can be used as a holding surface for the manipulator, a suction hand of the manipulator, for example, has not enough surface area in order to hold the multi-contact plug, socket or strip because the surface of the housing penetrated by the plug contact openings does not provide a sufficient, secure hold for a suction device.

For this reason, a holding unit, that can be additionally connected to the plug, socket or strip housing and has a holding surface by which a gripping device, especially a suction manipulator hand, can hold the multi-contact plug or socket, is employed in practice.

A disadvantage of this mounting method is that this additional holding unit is provided as a separate component. This requires additional costs for the manufacture as well as assembly.

This holding unit must be removed again before mounting of a further component. It is very disadvantageous that the mounting cycle time is prolonged by the additional mounting step, i.e., the removal of the holding unit from the component, and that, finally, this removed holding unit moreover must be added as disposable material to the production waste.

SUMMARY OF THE INVENTION

It is therefore a primary object of the invention to provide a new method and/or holding unit for the machine-operated placement of components of plug-in connections which, on the one hand, allows a tight placement of such components adjacent to one another and with which, on the other hand, the cycle time for mounting the components in the form of plug-in connections can be reduced while at the same time the use of auxiliary production material is lowered.

An auxiliary mounting means for an electrical plug-in connection according to the invention includes a pair of plug-in connection components, wherein at least one of the components has a holding unit with a substantially planar holding surface. The holding unit or the holding surface projects with a partial projecting area thereof at least past an outer lateral surface of the at least one component, wherein the projecting area projects into a plug-in area of the second component and wherein the projecting area is plastically deformable.

The advantages of the invention reside especially in that a holding unit, preferably a holding surface, required for mounting and additionally engaging the housing of the components of the plug-in connection, must no longer be necessarily physically removed from each component of the plug-in connection after mounting in order to achieve shorter mounting cycle times and/or a tight or even tighter placement of the components and/or, additionally, a lower consumption of auxiliary production material.

The aforementioned problem, which arises in context with the solutions according to the prior art, is solved especially in that another further component to be placed, in many cases the counterpart of the plug-in connection, in particular its movement during mounting, can be used in order to change the arrangement of or deform in a space-saving manner or, if necessary, to remove the holding unit, or partial areas thereof, for example, a holding surface still present on the neighboring component and projecting past the bodily dimensions of the housing, wherein preferably the partial areas or surfaces of the holding unit, which constitute a disturbance for the placement of the further component, are bent or buckled and these bent or buckled partial pieces then rest in particular against the outer surface of the housing of the plug-in connection part. In addition, the buckled partial pieces, according to a further embodiment of the invention, can be used as spacers or a guide surfaces for placing this further component or can be used as a locking member.

Even for printed circuit boards with, for example, relatively large placement spacing between two adjacent components, the holding unit must not be removed after mounting of the respective component because, in accordance with the invention, the aforementioned bending or buckling can be realized later by means of the oppositely positioned, neighboring plug-in connection part of the other printed circuit board when carrying out a plug-in movement that connects two printed circuit boards.

BRIEF DESCRIPTION OF THE DRAWING

The invention will be described in more detail in the following with the aid of embodiments schematically illustrated in the Figures. It is shown in.

DESCRIPTION OF THE PREFERRED EMBODIMENTS

Figure 1:
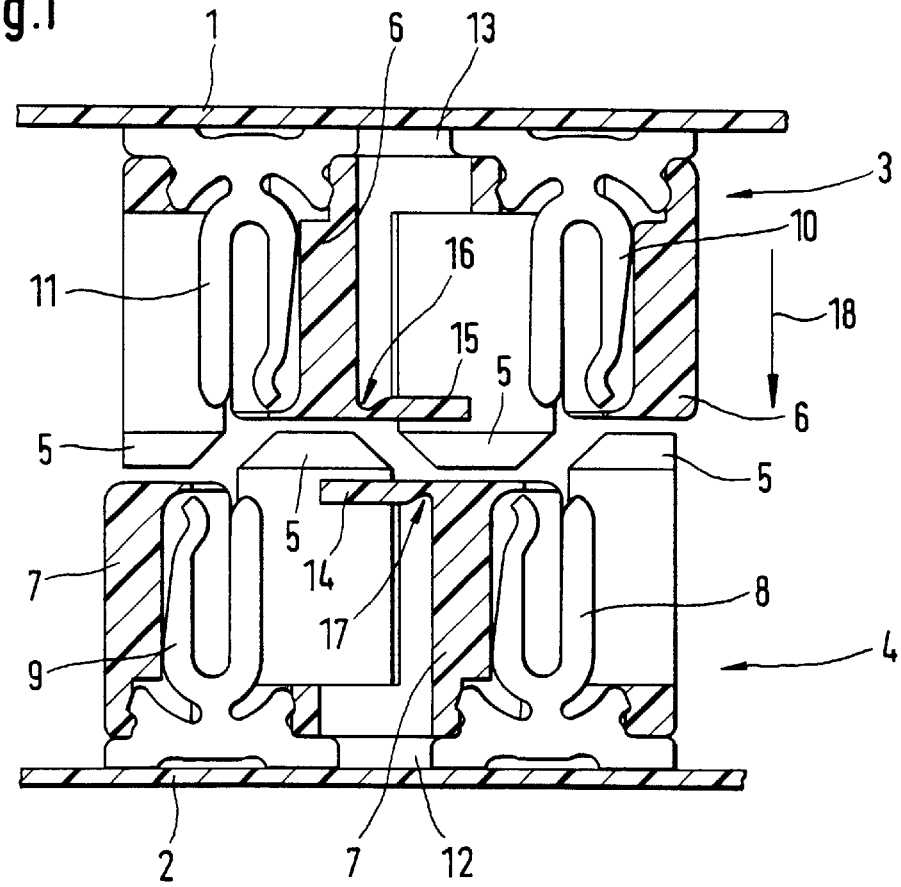
FIG. 1 a cross-section of two double-row plug-in strips, each fastened to a printed circuit board, immediately before being inserted into one another.

In FIG. 1 two basically known plug-in strips 3 and 4 of a multi-contact, double-row configuration, which are components of a plug-in connection, are mounted each on a printed circuit board 1 and 2. The contacts 8, 9, 10, 11, which in this embodiment are, for example, U-shaped, are surrounded partially by the corresponding plastic housings 6, 7; of course, other shapes of the contacts are also possible without deviating from the basic principle of the invention.

The facing surfaces of the plug-in strips 3, 4 are penetrated by plug-in openings. When assembling the two printed circuit boards 1 and 2 by insertion of the plug-in strips 3 and 4 into one another, the plug-in strip 3 is, for example, moved in the insertion direction 18. In order to facilitate the threading of the contacts 10 or 11 into the contacts 8 or 9, both plug-in strips 3, 4 are provided with guide noses 5, for example, at their narrow sides. The individual plug-in rows of a double-row plug-in strip 3, 4 are connected to one another and spaced from one another by bridges 12, 13.

In a specially embodiment, at least one holding surface 15 or 14 is arranged on each plug-in strip 3, 4 as an extension of their surface, wherein the holding surfaces provide the so-called holding unit according to the invention for machine-operated mounting thereof on the printed circuit boards 1 or 2. These holding surfaces 15 or 14 are preferably parts of the respective housing 6, 7 of the plug-in strips 3, 4. The holding surfaces 14 and 15 are provided in this embodiment laterally between the plug-in rows of each plug-in strip 3, 4 and represent a special situation which will be explained later with respect to FIGS. 3 through 5.

Before insertion of the double-row plug-in strips 3, 4 into one another, each holding surface 14, 15 forms a common planar surface with the other flush surface of the plug-in strip 3, 4. The suction hand 21 of a manipulator engages this common surface in order to place each plug-in strip 3, 4 onto the corresponding printed circuit board 1, 2.

Mounting of the plug-in strip 3 on the printed circuit board 1 is carried out from above onto the printed circuit board positioned underneath; the printed circuit board 1 together with the plug-in strip 3 is rotated only for the insertion of the printed circuit boards 1 and 2 into one another, as illustrated in FIG. 1, so that the printed circuit board 1 is positioned on top.

Figure 2:
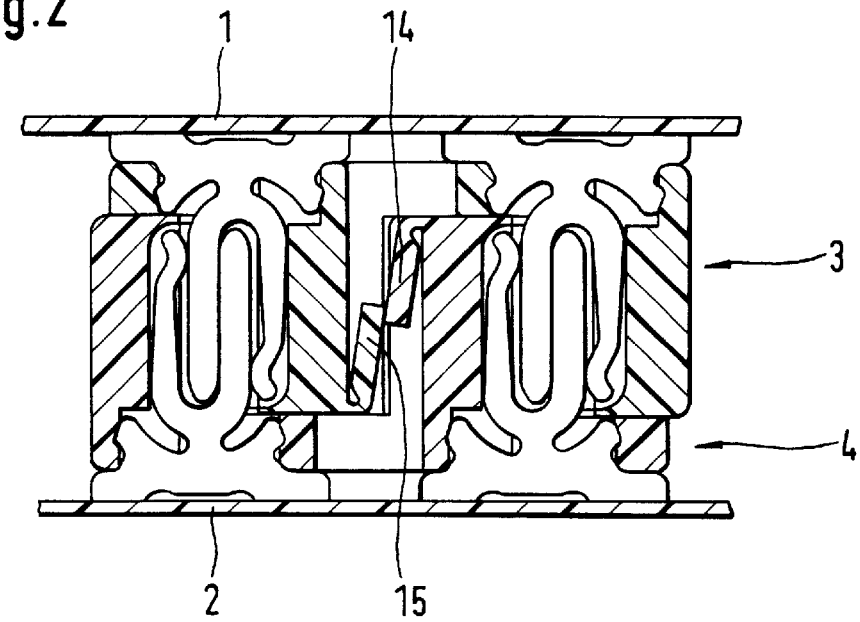
FIG. 2 a cross-section of the inserted double-row plug-in strips according to FIG. 1.

FIG. 2 illustrates the plug-in connection described already in connection with FIG. 1 after insertion into one another is completed. The holding surfaces 14, 15 are buckled substantially by 90 degrees and are resting against the facing outer surface of the housing of the plug-in strip 3 or 4. They have glided along one another during insertion after the insertion movement has initially caused their buckling. In order to facilitate the buckling process, defined buckling location 16, 17 are provided between the outer surfaces of the plug-in strip and the lower surface of the holding surfaces 14, 15.

The longitudinal extension of the folding surfaces 14, 15, that can be seen in the sectional view, is generally, as shown here in FIG. 2, dimensioned such that no hooking can occur. This means that the holding surfaces overlap partially in their shown longitudinal extension. Accordingly, the plug-in strips 3 and 4 can be separated from one another without causing destruction.

According to a further embodiment of the invention (not shown), the holding surfaces, on the other hand, can be shorter in their shown longitudinal extension so that no partial overlap would result. The ends of the holding surfaces 14 and 15 would then hook one another so that the plug-in connection of the plug-in strips 3 and 4 is secured.

Figure 3:
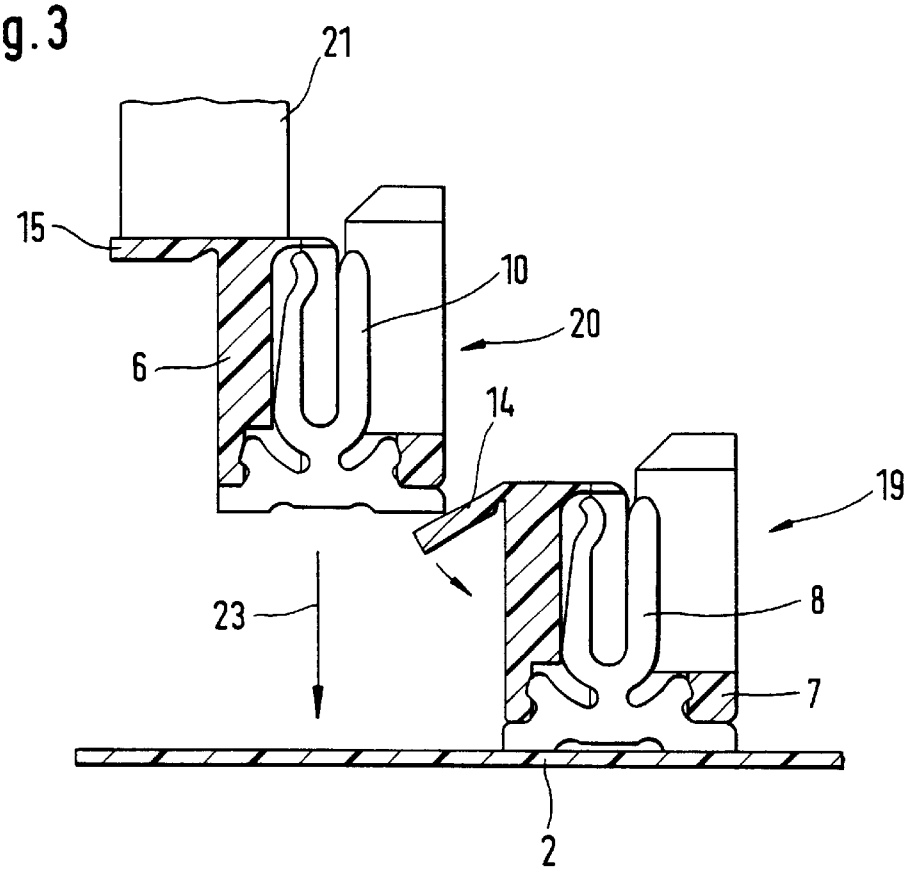
FIG. 3 a cross-section of two single-row plug-in strips being mounted on one and the same printed circuit board.
Figure 4:
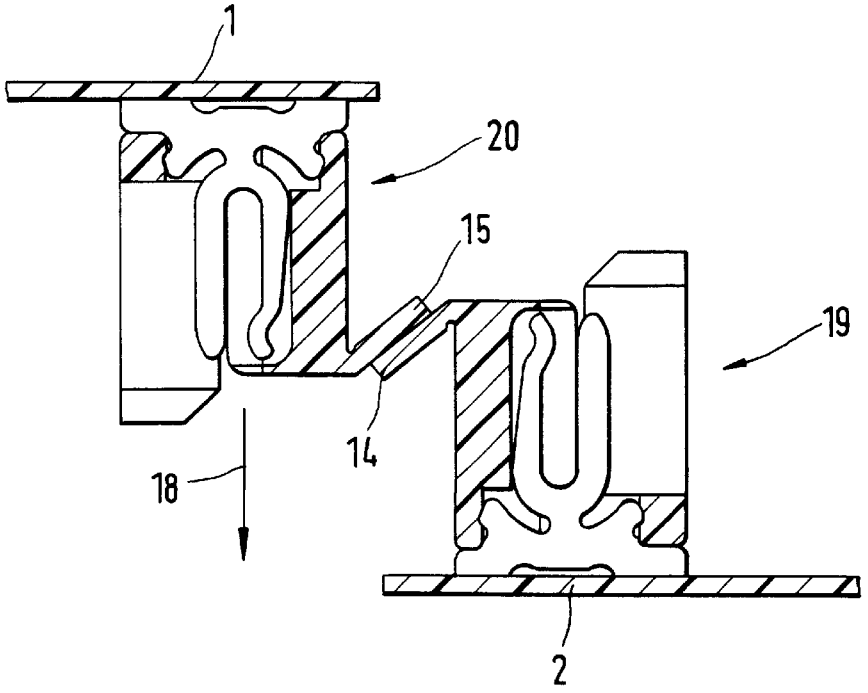
FIG. 4 a cross-section of two single-row plug-in strips, each mounted on a printed circuit board, during positioning of the printed circuit boards relative to one another.
Figure 5:
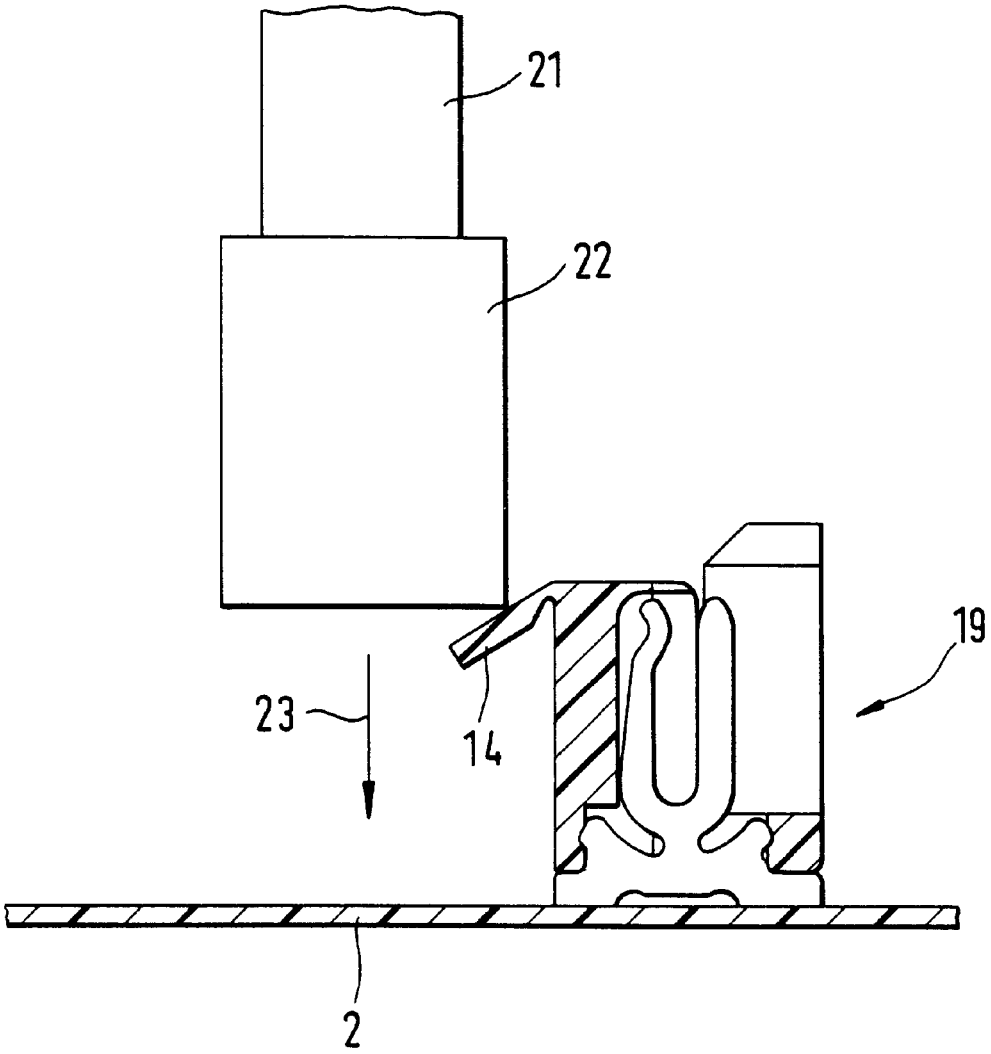
FIG. 5 a cross-section of an individual plug-in strip during mounting of a further component on one and the same printed circuit board.

The auxiliary mounting means according to the invention in the form of the holding surfaces 14, 15 can, however, also be used for single-row plug-in strips, with the difference that the holding surfaces 14, 15 according to the invention are now provided externally on the housing that is preferably made of plastic material. This embodiment is illustrated in FIGS. 3 through 5. In FIG. 3, the single-row plug-in strip 19 is already mounted on a printed circuit board 2. A second single row plug-in strip 20 is currently being moved by means of a suction hand 21 of a manipulator in the mounting direction 23 to the printed circuit board 2. The holding surface 14 required for mounting of the single-row plug-in strip 19 is now buckled by the foot of the second single-row plug-in strip 20. When further plug-in strips are mounted to the left adjacent to the single-row plug-in strip 20, the described process of bending/folding or buckling of the holding surfaces would respectively be repeated.

Also, when two single-row plug-in strips 19, 20 are mounted on different printed circuit boards 1, 2, the use of the inventive holding surfaces 14, 15 can be applied in a problem-solving way. This embodiment is illustrated in FIG. 4. In practice, it may occur that printed circuit boards, which are provided with components up to their edge, must be mounted closely adjacent to one another in a housing. The advantages of the new type of arrangement of the holding surfaces 14 and 15 would also apply here without affecting the mounting space.

In FIG. 5 a further application of the new holding surfaces is illustrated. A single-row plug-in strip 19 is already mounted on the printed circuit board 2. The suction hand 21 of a manipulator (or also any other configuration of the hand) guides a further electrical component in close proximity to the single-row plug-in strip 19 in the mounting direction 23 to the printed circuit board 2. The auxiliary holding surface 14 of the single-row plug-in strip 19 does not constitute a disturbance in this connection because the component 22 simply buckles the holding surface.

Finally, it should be mentioned also that the holding unit which is embodied in the above described examples in the form of a holding surface and which can be, moreover, a component of the housing 6 or 7, can also have other shapes or can be of any other type, for example, can be a holding unit with a corresponding holding surface 14 or 15 that is attachable to or has a self-clamping or snap-on action for securing it to the housing 6 or 7.

All of the features mentioned in the above description as well as those that can be taken only from the drawing are further components of the invention, even if they have not been specifically emphasized and, in particular, are not mentioned in the claims.

LIST OF REFERENCE NUMERALS

1 mounting surface (printed circuit board)
2 mounting surface (printed circuit board)
3 double-row plug-in strip
4 double-row plug-in strip
5 guide noses
6 housing (of plastic material; of item 3)
7 housing (of plastic material; of item 4)
8 contact (preferably U-shaped)

9 contact (preferably U-shaped)
10 contact (preferably U-shaped)
11 contact (preferably U-shaped)
12 bridge (of item 4)
13 bridge (of item 3)
14 holding surface (of a holding unit)
15 holding surface (of a holding unit)
16 buckling location (of items 15 and 6)
17 buckling location (of items 14 and 7)
18 insertion direction
19 single-row plug-in strip
20 single-row plug-in strip
21 gripping unit (suction hand of a manipulator)
22 electrical component
23 mounting direction

What is claimed is:

1. An auxiliary mounting means for an electrical plug-in connection comprising a pair of first and second plug-in connection components, wherein at least the first component comprises a holding unit having a substantially planar holding surface, wherein the holding unit or the holding surface projects with a partial projecting area thereof at least past an outer lateral surface of the first component, wherein the second component has a plug-in area, wherein the projecting area projects into the plug-in area of the second component, and wherein the projecting area is plastically deformable.

2. The auxiliary mounting means according to claim 1, wherein the connection components are comprised of plug-in strips, and wherein each plug-in strip has a holding surface.

3. The auxiliary mounting means according to claim 2, wherein the plug-in strips are comprised of a multi-contact plug and a female multi-contact connector.

4. The auxiliary mounting means according to claim 2, wherein the plug-in strips are comprised of double-row substantially U-shaped plug-in strips.

5. The auxiliary mounting means according to claim 1, wherein the holding surface has defined integrally formed buckling location.

* * * * *